United States Patent [19]

Kartman

[11] 4,385,730

[45] May 31, 1983

[54] ROLLER MILL

[75] Inventor: Helge C. C. Kartman, Copenhagen, Denmark

[73] Assignee: F. L. Smidth & Co., Cresskill, N.J.

[21] Appl. No.: 194,589

[22] Filed: Oct. 6, 1980

[30] Foreign Application Priority Data

Oct. 18, 1979 [GB] United Kingdom ..... 7936199

[51] Int. Cl.[3] ..... B02C 23/24

[52] U.S. Cl. ..... 241/57; 241/117

[58] Field of Search ..... 241/57, 60, 107, 109, 241/110, 117–122; 366/105

[56] References Cited

U.S. PATENT DOCUMENTS

| | | | |
|---|---|---|---|
| 2,684,818 | 7/1954 | Loesche . | |
| 3,511,445 | 5/1970 | Ashdown . | |
| 3,905,559 | 9/1975 | Brundiek | 241/59 |
| 4,234,132 | 11/1980 | Maliszewski, Jr. | 241/53 |
| 4,235,385 | 11/1980 | Brundiek . | |

FOREIGN PATENT DOCUMENTS

| | | |
|---|---|---|
| 967783 | 7/1949 | Fed. Rep. of Germany . |
| 1152297 | 8/1963 | Fed. Rep. of Germany . |
| 2309900 | 2/1973 | Fed. Rep. of Germany . |
| 2838782 | 10/1980 | Fed. Rep. of Germany . |
| 371034 | 4/1932 | United Kingdom . |
| 858295 | 1/1961 | United Kingdom . |
| 870370 | 6/1961 | United Kingdom . |
| 943450 | 12/1963 | United Kingdom . |
| 998629 | 7/1965 | United Kingdom . |
| 2008973 | 6/1979 | United Kingdom . |

*Primary Examiner*—Mark Rosenbaum
*Assistant Examiner*—Timothy V. Eley
*Attorney, Agent, or Firm*—Pennie & Edmonds

[57] ABSTRACT

A nozzle ring assembly for use around a circular grinding path of a roller mill of the kind comprising a grinding table which is rotatable about a vertical axis, and grinding rollers urged against the grinding table. The nozzle ring assembly comprises a nozzle ring with circumferentially spaced guide vanes for directing air, in use, over the grinding path in a direction with a component substantially tangential to the grinding path. The nozzle ring also has a set of annular guide vanes which are disposed one above the other for directing air, in use, substantially horizontally over the grinding path.

13 Claims, 4 Drawing Figures

FIG. 3
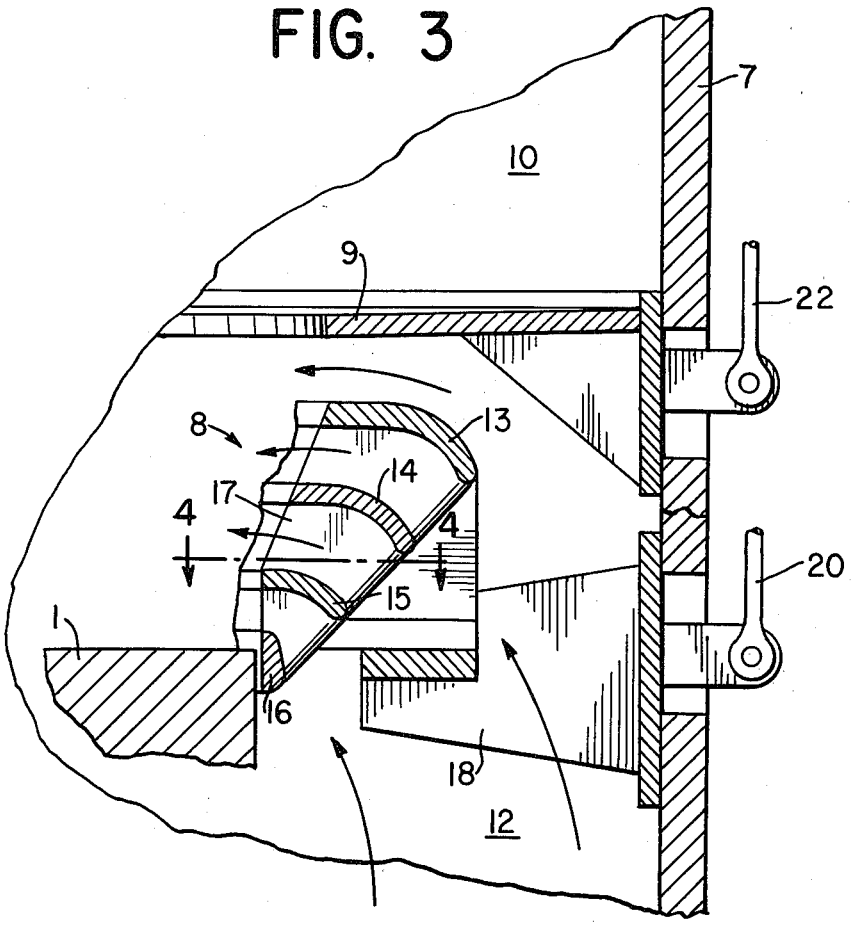
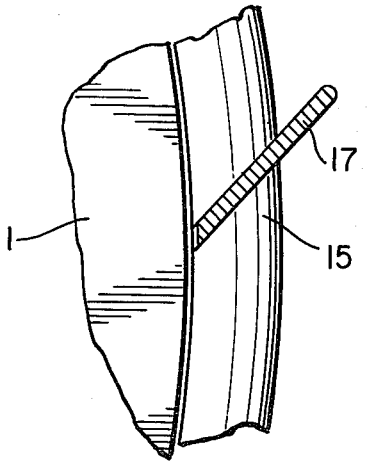
FIG. 4

ROLLER MILL

TECHNICAL FIELD

This invention relates to a roller mill and more particularly to a nozzle ring assembly for use around a grinding path of a roller mill.

BACKGROUND ART

In the case of a roller mill including a grinding table which is rotatable about a vertical axis, and grinding rollers urged against the grinding table, the grinding table may rotate around the vertical mill axis with the grinding rollers being immovable in the direction of rotation. However, the rollers are movable up and down while being urged against the grinding table, for example, by means of draw bars activated by hydraulic cylinders. The roller mill is encased in a housing which is divided into a lower part under the grinding table and an upper part above the grinding table. The two parts or chambers into which the mill housing is divided, are interconnected via a nozzle ring, an annular passage of which is substantially vertically oriented. Air is directed into an air duct in the lower part of the mill housing and then up around the grinding table through the nozzle ring, the guide vanes of which direct the air into the upper part of the mill housing and over the grinding table in a direction with a component substantially tangential to the grinding table. Above the nozzle ring there is normally a conical, air guiding wall which further forces the air to flow over the grinding table.

The air passed to the upper part of the mill housing is used partly for transporting ground material from around the grinding table upwards and hence out of the mill, partly for drying the material if it is moist, and partly for cooling the ground material.

In order to avoid that material whirled around in the mill housing by the air and the rotating parts of the mill falls down on to the nozzle ring and clogs it, or even through the nozzle ring into the air duct in the lower part of the housing, comparatively high air velocities are required through the nozzle ring. However, this entails a rather large pressure drop across the nozzle ring. As relatively large unground pieces of material may fall on the nozzle ring, it will be appreciated that the air velocity necessary for keeping the nozzle ring clean and the equivalent air consumption are often larger than necessary for transporting and cooling and, if necessary, drying the ground material.

To keep the air suction energy consumption as low as possible, it is desirable that the amount of air supplied does not exceed what is required for transporting, cooling, and possible drying the ground material. When grinding already dry materials it is not even necessary to use air for drying them.

Roller mills of the kind as described above are known in which the air velocities through the nozzle ring are comparatively low, but in which, on the other hand, unground material is allowed to pass down through the nozzle ring to a lower portion of the mill housing. At that lower portion there is a conveyor for conveying the material out of the lower portion of the mill housing to an elevator which returns the material to the upper part of the mill housing.

DISCLOSURE OF THE INVENTION

The present invention relates to a nozzle ring assembly for use in a roller mill including a grinding table rotatable about a substantially vertical axis and defining a grinding path, and at least one grinding roller urged against the grinding table, comprising a plurality of spaced apart guide vanes positioned one above the other for directing air generally horizontally over the grinding path.

In a preferred embodiment, the present invention relates to a nozzle ring assembly for use around a generally circular grinding path of a roller mill including a grinding table rotatable about a vertical axis, and at least one grinding roller urged against the grinding table, comprising a nozzle ring including a plurality of first guide vanes spaced apart circumferentially of the grinding table such that each first guide vane is capable of directing air over the grinding path in a direction offset from the radial of the grinding path, the nozzle ring further including a plurality of second guide vanes having a generally annular configuration and being positioned one above the other such that the second guide vanes are capable of directing air substantially horizontally over the grinding path.

A roller mill provided with a nozzle ring assembly according to the present invention may be arranged with an air velocity which gives minimal pressure drop at a desired recirculation of material down past the nozzle ring assemblies.

Preferably, in use, the nozzle ring has no upwardly directed openings through which material can fall directly from the upper part of the mill housing into its lower part. The annular guide vanes disposed one above the other cover and shield the nozzle openings and air directed inwardly between the annular guide vanes blows the falling material inwardly away from the nozzle openings. It will be appreciated that considerably lower air velocities are required for blowing the substantially horizontal parts of the guide vanes free of material than are required for blowing free the vertically oriented ring slit of the known nozzle rings.

By positioning the nozzle ring in the vertical direction it is also possible to determine the thickness of the grinding layer. In addition, the lowermost annular guide vane may be arranged, in use, to form a dam ring for the grinding path.

The thickness of the grinding layer may be varied by making the nozzle ring vertically adjustable. Of course, it is also a possibility to make only the dam ring vertically adjustable.

The nozzle ring assembly may further comprise a substantially horizontally oriented sealing ring disposed above the uppermost annular guide vane. By vertical positioning of the guide vanes relative to the sealing ring it is possible, to a certain extent, to regulate the air velocity and amount of air blast through the nozzle ring assembly.

The sealing ring may further be vertically adjustable relatively to the guide vanes so that it is possible independently both to regulate the thickness of the grinding layer and the amount of air blast through the nozzle ring.

The nozzle ring and/or sealing ring could be made in angular segments, each segment being independently vertically adjustable to account for variations in the air blast around the nozzle ring assembly.

Outlet ends of the annular guide vanes need only be substantially horizontal, i.e., it is not significant if the outlet ends of the annular guide vanes are slightly upwardly or slightly downwardly inclined. It is, however, preferable if the outlet ends of the annular guide vanes slope slightly downwardly towards the grinding path, as grinding material falling on the guide vanes can be even more easily blown away.

To be able to position the guide vanes of the nozzle ring as well as the sealing ring during operation of the mill, it is preferable if they can be adjusted from outside the housing of a mill in which, in use, the assembly is fitted.

It is also useful if means are provided outside the mill housing for checking or indicating the positions of the guide vanes of the nozzle ring and of the sealing ring from outside the mill housing.

The present invention also relates to a roller mill which comprises a housing having an upper section and a lower section, a grinding table defining a generally circular grinding path disposed within the lower section and rotatable about a generally vertical axis, at least one grinding roller urged against the grinding table for engaged rotation along the grinding path as the grinding table rotates, means for directing air to the lower section and to the upper section for at least one of transporting, cooling and drying the ground material, a nozzle ring assembly for directing air over the grinding path in directions having at least one component substantially tangential to the grinding path, the nozzle ring assembly including a plurality of annular guide vanes disposed in spaced relation one above the other and configured and positioned to at least partially regulate the air velocity and amount of air passing through the nozzle ring assembly.

BRIEF DESCRIPTION OF THE DRAWINGS

The present invention is described in detail below with reference to the drawings in which:

FIG. 3 is an enlarged cross-section taken along the line 3—3 of FIG. 2; and FIG. 4 is a top view taken along the line 4—4 of FIG. 3.

DESCRIPTION OF THE BEST MODE FOR CARRYING OUT THE INVENTION

Figure 1:
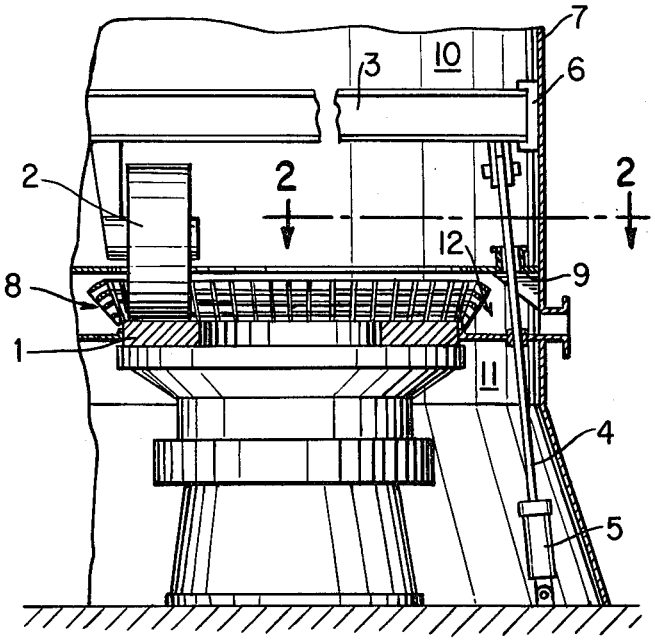
FIG. 1 is a diagrammatic vertical section through a portion of a roller mill of the present application.

The mill shown in FIG. 1 comprises a grinding table 1 on which several grinding rollers 2 roll. For the sake of simplicity only one grinding roller is shown. The grinding rollers 2 according to the embodiment illustrated in FIG. 1, are suspended from a pressure frame 3 which is urged against the grinding table 1 by means of draw bars 4 with hydraulic cylinders 5, of which only one set is shown for the sake of convenience of illustration.

In the embodiment as shown, the pressure frame 3 and consequently the rollers are retained from movement in the direction of rotation of the grinding table 1 by stops 6, while the grinding table 1 rotates.

The mill is encased in a housing 7 which is divided, by means of a nozzle ring assembly comprising a nozzle ring 8 and a sealing ring 9, into an upper part 10 above the grinding table and a lower part 11 under the grinding table.

The material to be ground on the grinding table 1 is fed to the upper part 10 of the housing. Air for conveying ground material out of the mill housing and for cooling and perhaps drying the material is fed to an air duct 12 in the lower part 11 of the housing and from there up through the nozzle ring 8 around the grinding table into the upper part 10 of the housing.

As appears more clearly from FIGS. 3 and 4, the nozzle ring 8 comprises four annular guide vanes 13, 14, 15 and 16 disposed one above the other. The guide vanes are so configured that air from the lower part of the housing is directed in use, radially inwards in a substantially horizontal direction over the grinding table 1, as indicated by arrows in FIG. 3.

Figure 2:
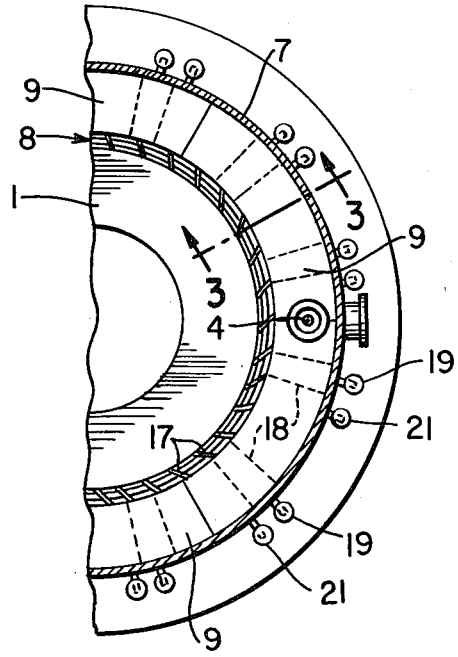
FIG. 2 is a top view of the roller mill of FIG. 1 taken along the line 2—2.

The guide vanes 13, 14, 15 and 16 are secured to each other by means of vertical guide vanes 17 as shown in FIGS. 2 and 4. Each guide vane 17 forms an angle with the tangent to the circumference of each guide vane 13, 14, 15 and 16 at the point of attachment of the vane 17 to the respective vane 13, 14, 15 and 16. Furthermore, the guide vanes 17 impart to the air blast around the grinding table a component tangential to the grinding table.

The arrangement of guide vanes 13, 14, 15, 16 and 17 is suspended in brackets 18 which are adjustable in a vertical direction, e.g., by means of hydraulic cylinders 19 on the outside of the mill housing 7, as indicated in FIG. 2. The piston rods 20 of the cylinders 19 are shown in FIG. 3. Above the nozzle ring 8 is the sealing ring 9 which is also adjustable in a vertical direction, e.g., by means of hydraulic cylinders 21 as indicated in FIG. 2. The piston rods 22 of the cylinders 21 being shown in FIG. 3.

The sealing ring 9 and the guide vanes 13, 14, 15 and 16 together cover the annular space between the mill housing 7 and the grinding table 1, and prevent material from falling from the upper chamber 10 of the mill housing into the air duct 12. Furthermore, the sealing ring 9 and the outlet end of the guide vanes 13, 14 and 15 slope slightly downwardly towards the grinding table and thus help to ensure that material falling onto the sealing ring 9 and the guide vanes is more easily returned to the grinding path.

The lowermost guide vane 16 is in the form of a dam ring around the grinding table 1, and the thickness of the layer of grinding material on the grinding table 1 can be varied by vertically adjusting the nozzle ring 8. The interrelated vertical adjustability of the sealing ring 9 and the nozzle ring 8 permits regulation of the air supply.

Instead of two sets of hydraulic cylinders 19 and 21 for independently adjusting of the nozzle ring 8 and the sealing ring 9, respectively, the sealing ring 9 and the nozzle ring 8 may also be interconnected and adjustable by means of, e.g., one single set of hydraulic cylinders.

Furthermore, the lowermost guide vane 16 could be adjustable independently of the other guide vanes 13, 14 and 15 of the nozzle ring 8.

In connection with the piston rods 20 and 22 outside the mill housing 7, there may be marks of indicators which show the positions of the nozzle ring 8 and the sealing ring 9, respectively.

I claim:

1. A roller mill comprising a grinding table rotatable about a substantially vertical axis and defining a grinding path, at least one grinding roller urged against the grinding table, a nozzle ring assembly including a plurality of generally annular spaced apart guide vanes positioned one above the other for directing substantially all of the air generally horizontally over the grinding path.

2. A roller mill comprising a grinding table having a generally circular grinding path and being rotatable about a vertical axis, at least one grinding roller urged against the grinding table, a nozzle ring including a plurality of first guide vanes spaced apart circumferentially of the grinding table such that each first guide vane is capable of directing air over the grinding path in a direction having a component substantially tangential to the grinding path, the nozzle ring further including a plurality of generally annular second guide vanes being positioned one above the other such that the second guide vanes are capable of directing substantially all of the air substantially horizontally over the grinding path.

3. The roller mill according to claim 2, wherein the lowermost annular guide vane is positioned so as to form a dam ring for the grinding path.

4. The roller mill according to claim 3 further comprising means for adjusting the nozzle ring in a generally vertical direction.

5. The roller mill according to claim 4 further comprising a substantially horizontally oriented sealing ring positioned above the nozzle ring.

6. The roller mill according to claim 5 further comprising means for adjusting the sealing ring in a generally vertical direction relative to the nozzle ring.

7. The roller mill according to claim 6, wherein the roller mill is positioned within a housing and the guide vanes of the nozzle ring and the sealing ring are adjustable from outside the housing of the mill.

8. The roller mill according to claim 7 further comprising means for indicating the positions of the guide vanes of the nozzle ring and of the sealing ring from outside the mill housing.

9. The roller mill according to claim 8, wherein the inner ends of the annular guide vanes slope slightly downwardly towards the grinding path.

10. A roller mill comprising a grinding table having a generally circular grinding path and being rotatable about a vertical axis, a pressure frame, a grinding roller suspended from the pressure frame and being urged against the grinding table, a nozzle ring assembly including a nozzle ring and a sealing ring positioned thereabove, said nozzle ring having a plurality of first guide vanes spaced apart circumferentially of the grinding table such that each first guide vane is capable of directing air over the grinding path in a direction having a component substantially tangential to the grinding path, the nozzle ring further including a plurality of generally annular second guide vanes being positioned one above the other such that the second guide vanes are capable of directing substantially all of the air substantially horizontally over the grinding path, said nozzle ring and said sealing ring each being adjustable in a vertical direction.

11. A roller mill comprising a grinding table rotatable about a vertical axis and defining a generally circular grinding path, a plurality of grinding rollers urged downwardly against the grinding table, and a nozzle ring assembly, said nozzle ring assembly having a plurality of spaced apart generally annular guide vanes positioned one above the other for directing substantially all of the air generally horizontally over the grinding path.

12. A roller mill comprising a grinding table rotatable about a vertical axis and defining a generally circular grinding path, a plurality of grinding rollers urged against the grinding table along the grinding path for grinding material therebetween, a nozzle ring assembly including a nozzle ring with circumferentially spaced guide vanes for directing air, in use, over the grinding path in a direction with a component substantially tangential to the grinding path, the nozzle ring further including a plurality of annular guide vanes which are disposed one above the other for directing substantially all of the air, in use, substantially horizontally over the grinding path.

13. A roller mill which comprises a housing having an upper section and a lower section, a grinding table defining a generally circular grinding path disposed within said lower section and rotatable about a generally vertical axis, at least one grinding roller urged against said grinding table for engaged rotation along said grinding path as said grinding table rotates, means for directing air to said lower section and to said upper section for at least one of transporting, cooling and drying the ground material, a nozzle ring assembly for directing air over the grinding path in a direction having at least one component substantially tangential to the grinding path, said nozzle ring assembly including a plurality of annular guide vanes disposed in spaced relation one above the other and configured and positioned so as to at least partially regulate the air velocity and amount of air passing through said nozzle ring assembly, said annular guide vanes directing substantially all of the air substantially horizontally over the grinding path.

* * * * *

UNITED STATES PATENT AND TRADEMARK OFFICE

CERTIFICATE OF CORRECTION

PATENT NO. : 4,385,730

DATED : May 31, 1983

INVENTOR(S) :

It is certified that error appears in the above-identified patent and that said Letters Patent is hereby corrected as shown below:

On the title page under References Cited U.S. Patent Documents "2,684,818" should be --2,684,813--.

Signed and Sealed this

*Thirtieth* Day of *August 1983*

[SEAL]

*Attest:*

GERALD J. MOSSINGHOFF

*Attesting Officer*

*Commissioner of Patents and Trademarks*